US009599010B2

(12) United States Patent
Ichihara et al.

(10) Patent No.: US 9,599,010 B2
(45) Date of Patent: Mar. 21, 2017

(54) COOLING DEVICE FOR INTERNAL COMBUSTION ENGINE, AND COOLING METHOD FOR INTERNAL COMBUSTION ENGINE

(71) Applicant: Nissan Motor Co., Ltd., Kanagawa (JP)

(72) Inventors: Takayoshi Ichihara, Kanagawa (JP); Aiko Kawamoto, Kanagawa (JP); Yoshimi Oko, Kanagawa (JP)

(73) Assignee: NISSAN MOTOR CO., LTD., Kanagawa (JP)

( * ) Notice: Subject to any disclaimer, the term of this patent is extended or adjusted under 35 U.S.C. 154(b) by 0 days.

(21) Appl. No.: 14/902,211

(22) PCT Filed: May 19, 2014

(86) PCT No.: PCT/JP2014/063184

§ 371 (c)(1),
(2) Date: Dec. 30, 2015

(87) PCT Pub. No.: WO2015/001855

PCT Pub. Date: Jan. 8, 2015

(65) Prior Publication Data

US 2016/0160739 A1 Jun. 9, 2016

(30) Foreign Application Priority Data

Jul. 1, 2013 (JP) ..... 2013-138011

(51) Int. Cl.
*F01P 7/16* (2006.01)
*F01P 11/14* (2006.01)
(Continued)

(52) U.S. Cl.
CPC *F01P 7/16* (2013.01); *F01P 3/20* (2013.01); *F01P 5/10* (2013.01); *F01P 11/14* (2013.01);
(Continued)

(58) Field of Classification Search
CPC ..... F01P 7/16; F01P 7/165; F01P 3/20; F01P 5/10; F01P 11/14; F01P 11/16; F01P 11/18; F01P 2007/146
See application file for complete search history.

(56) References Cited

U.S. PATENT DOCUMENTS

2009/0140055 A1 6/2009 Iwasaki

FOREIGN PATENT DOCUMENTS

DE 102005045499 A1 4/2007
JP 2007-100767 A 4/2007
(Continued)

OTHER PUBLICATIONS

Espacenet Machine Translation of the Specification of DE 10 2005 045 499 A1.*

(Continued)

*Primary Examiner* — Jacob Amick
(74) *Attorney, Agent, or Firm* — Osha Liang LLP

(57) ABSTRACT

A control unit stores a correlation between a temperature difference ΔT between an inlet temperature and an outlet temperature of a heat exchanger for cooling of cooling water, and the amount of thermal deformation occurring in the heat exchanger. At the time when the cooling water is supplied to the heat-exchanging flow path having the heat exchanger, the control unit refers to the temperature difference ΔT and the correlation to obtain the volume of flow of the cooling water supplied to the heat-exchanging flow path so that the amount of thermal deformation is less than or equal to a threshold amount of thermal deformation set in advance.

5 Claims, 3 Drawing Sheets

(51) Int. Cl.

| | |
|---|---|
| ***F01P 3/20*** | (2006.01) |
| ***F01P 5/10*** | (2006.01) |
| ***F01P 11/16*** | (2006.01) |
| *F01P 7/14* | (2006.01) |

(52) U.S. Cl.
CPC ..... *F01P 11/16* (2013.01); *F01P 2007/146* (2013.01); *F01P 2025/32* (2013.01); *F01P 2025/34* (2013.01); *F01P 2025/36* (2013.01); *F01P 2025/50* (2013.01); *F01P 2025/52* (2013.01)

(56) References Cited

FOREIGN PATENT DOCUMENTS

| | | | |
|---|---|---|---|
| JP | 2008-037302 | A | 2/2008 |
| JP | 2008-239014 | A | 10/2008 |
| JP | 2010-242525 | A | 10/2010 |

OTHER PUBLICATIONS

International Preliminary Report on Patentability issued in corresponding Application No. PCT/JP2014/063184, mailed on Jan. 14, 2016 (13 pages).

* cited by examiner

COOLING DEVICE FOR INTERNAL COMBUSTION ENGINE, AND COOLING METHOD FOR INTERNAL COMBUSTION ENGINE

CROSS-REFERENCE TO RELATED APPLICATIONS

The present application is a national stage application of PCT/JP2014/063184 filed May 19, 2014, and claims priority to Japanese Patent Application No. 2013-138011, filed on Jul. 1, 2013, the content of which are incorporated herein by reference in their entirety.

BACKGROUND

Technical Field

The present invention relates to a cooling device for an internal combustion engine, and a cooling method for an internal combustion engine, in particular, relates to a technique for preventing a heat exchanger from being damaged due to thermal deformation when cooling water having increased temperature is supplied to the heat exchanger.

Related Art

An internal combustion engine mounted on a vehicle is provided with a cooling-water flow path, which allows cooling water to pass therethrough. In the case where temperatures of the internal combustion engine are desired to be reduced, the cooling water is caused to flow within the heat exchanger (for example, a radiator) to reduce temperatures of the cooling water, and then, the cooling water, having reduced temperature, is caused to pass through the cooling-water flow path of the internal combustion engine. The cooling water passing through the cooling-water flow path in the heat exchanger exchanges heat with the internal combustion engine, whereby temperatures of the internal combustion engine are controlled so as to be a desired temperature.

If the cooling water having increased temperature suddenly enters the heat exchanger at normal temperatures at the start of the internal combustion engine, a temperature difference takes place before and after the entrance of the cooling water, which causes the heat exchanger to suffer from thermal impact (also referred to as "thermal shock"). This thermal impact possibly leads to occurrence of thermal deformation in the heat exchanger. With the aim of alleviating the thermal deformation, Patent Literature 1 discloses a technique of detecting an inlet temperature and an outlet temperature of the cooling water passing through the heat exchanger, and controlling the volume of flow of the cooling water supplied to the heat exchanger so that the difference in temperatures does not increase.

CITATION LIST

Patent Literature

Patent Literature 1: Japanese Patent Laid-Open Publication No. 2008-37302

SUMMARY OF INVENTION

The controlling method disclosed in Patent Literature 1 described above alleviates the thermal impact occurring in the heat exchanger by causing the cooling water having a temperature increased through the internal combustion engine to flow in the heat exchanger to raise a temperature of the heat exchanger so that a temperature difference between the internal combustion engine and the heat exchanger does not increase.

Thus, part of the cooling water is supplied to the heat exchanger even in the case where temperatures of the internal combustion engine need to be increased as rapidly as possible. As a result, heat generated is used not only to raise a temperature of the internal combustion engine but also to raise a temperature of the heat exchanger, which may cause delay in an increase in temperatures of the internal combustion engine.

One or more embodiments of the present invention provides a cooling device for an internal combustion engine, and a cooling method for an internal combustion engine, which can alleviate thermal deformation occurring in the heat exchanger when cooling water having increased temperature is supplied to the heat exchanger.

One or more embodiments the present invention includes: a switching unit provided on an outlet side of a cooling-water flow path for cooling an internal combustion engine, and configured to branch the cooling-water flow path into either a heat-exchanging flow path having a heat exchanger for cooling of cooling water disposed therein or a bypass flow path without the heat exchanger, or both; an inlet temperature detector that detects a temperature of the cooling water supplied to the heat exchanger; an outlet temperature detector that detects a temperature of the cooling water discharged from the heat exchanger; and a controller that controls distribution, in the switching unit, of the volume of flow of the cooling water to the heat-exchanging flow path and the bypass flow path. The controller obtains a temperature difference between an inlet temperature and an outlet temperature of the heat exchanger. Furthermore, there is provided a storage unit that stores a correlation with respect to the amount of thermal deformation occurring in the heat exchanger. When the cooling water is supplied to the heat-exchanging flow path, the temperature difference and the correlation are referred to, and the volume of flow of the cooling water supplied to the heat-exchanging flow path is obtained so that the amount of thermal deformation is less than or equal to the threshold amount of thermal deformation set in advance.

DETAILED DESCRIPTION

Figure 1:
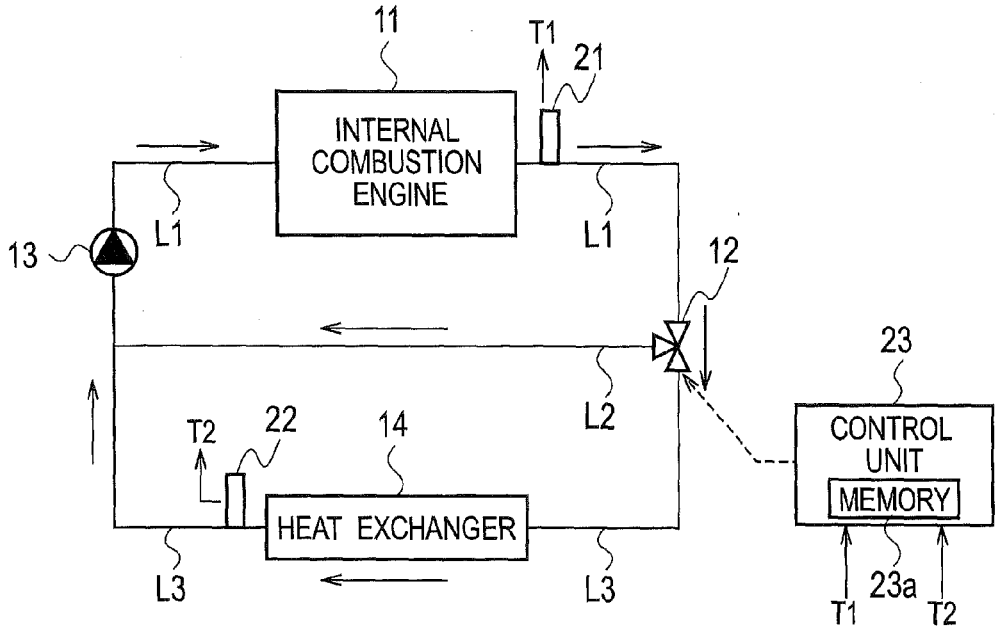
FIG. 1 is a block diagram illustrating a configuration of a cooling device for an internal combustion engine according to one or more embodiments of the present invention.

Hereinbelow, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 is a block diagram illustrating the configuration of a cooling device for an internal combustion engine according to one or more embodiments of the present invention. As illustrated in FIG. 1, a cooling device according to one or more embodiments of the present includes: a cooling-water flow path L1 configured to supply an engine 11 with cooling water for cooling; a circulation pump 13 that circulates the cooling water through the cooling-water flow path L1; and a three-way valve 12 provided at an outlet end portion of the cooling-water flow path L1 and configured to divide, into two lines, the cooling water that has passed through the engine 11.

The three-way valve 12 distributes and outputs the cooling water supplied through the cooling-water flow path L1 to a bypass flow path L2 and a heat-exchanging flow path L3. The bypass flow path L2 is connected with an inlet side of the circulation pump 13. The heat-exchanging flow path L3 passes through a heat exchanger 14 (for example, a radiator) for cooling the cooling water, and is connected with an inlet side of the circulation pump 13. In other words, the three-way valve 12 (switching unit) is provided on the outlet side of the cooling-water flow path L1, and has a function of branching the cooling-water flow path L1 into either the heat-exchanging flow path L3 having a heat exchanger 14 for cooling the cooling water disposed therein or the bypass flow path L2 that does not have the heat exchanger 14, or both. The three-way valve 12 supplies the cooling water to the bypass flow path L2 and the heat-exchanging flow path L3 in accordance with signals from a control unit 23, which will be described later.

Furthermore, a first temperature detecting unit 21 (inlet temperature detector) that detects temperatures of the cooling water flowing through the cooling-water flow path L1 is provided on the cooling-water flow path L1 and in the vicinity of the outlet of the engine 11. Since the outlet end portion of the cooling-water flow path L1 is connected with the inlet of the heat exchanger 14 by way of the heat-exchanging flow path L3, temperatures detected by the first temperature detecting unit 21 are equivalent to an inlet temperature T1 of the cooling water supplied to the heat exchanger 14. On the other hand, a second temperature detecting unit 22 (outlet temperature detector) that detects an outlet temperature T2, which is a temperature of the cooling water that has passed through the heat exchanger 14, is provided on the heat-exchanging flow path L3 and in the vicinity of the outlet of the heat exchanger 14. Note that the "detects a temperature" represents an idea including directly making measurements using a sensor, and making an estimation on the basis of the volume of flow of the cooling water or other factors.

The three-way valve 12 includes the control unit 23 that controls the degree of opening of the three-way valve 12. The control unit 23 acquires the inlet temperature T1 and the outlet temperature T2, and controls the degree of opening of the three-way valve 12 on the basis of these pieces of data on temperatures. In other words, the control unit 23 has a function of a controller that controls distribution, in the three-way valve 12, of the volume of flow of the cooling water to the heat-exchanging flow path L3 and the bypass flow path L2.

Furthermore, the control unit 23 stores, in a memory 23*a* (map storage unit), a correspondence map (which will be described later in detail) indicating a correlation among three items: a temperature difference ΔT between the inlet temperature T1 and the outlet temperature T2; the volume of flow of the cooling water supplied to the heat exchanger 14; and the amount of thermal deformation occurring in the heat exchanger 14 due to thermal impact.

When the temperature difference ΔT is detected, the control unit 23 refers to the correspondence map on the basis of this temperature difference ΔT, and sets the volume of flow of the cooling water so that the amount of thermal deformation occurring in the heat exchanger 14 is less than or equal to the value of the threshold amount of thermal deformation set in advance. Then, the control unit 23 controls the degree of opening of the three-way valve 12 so as to achieve the set volume of flow.

The control unit 23 includes the memory 23*a* (map storage unit) that stores the correspondence map indicating a correlation among the three items: a temperature difference ΔT indicating a difference between the cooling water temperature detected by the first temperature detecting unit 21 and the cooling water temperature detected by the second temperature detecting unit 22; the volume of flow of the cooling water supplied to the heat exchanger 14; and the amount of thermal deformation occurring in the heat exchanger 14 due to thermal impact. The control unit 23 refers to the correspondence map using the temperature difference ΔT when the cooling water flows through the heat-exchanging flow path L3, and obtains the volume of flow of the cooling water flowing through the heat-exchanging flow path L3 so that the amount of thermal deformation is less than or equal to the value of the threshold amount of thermal deformation set in advance. In addition, the control unit 23 has a function of controlling distribution, in the three-way valve 12, of the volume of flow of the cooling water so as to achieve the obtained volume of flow of the cooling water.

It should be noted that the control unit 23 may be configured as an integral-type computer including, for example, a central processing unit (CPU), and a storage unit such as a RAM, a ROM, and a hard disk.

Figure 2:
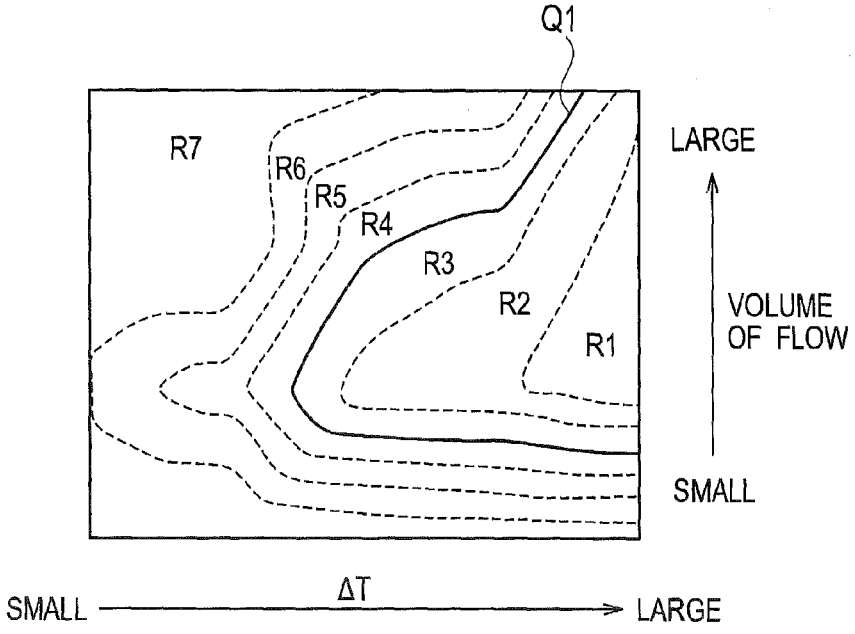
FIG. 2 is a correspondence map showing a relationship among three items: temperature difference $\Delta T$, the volume of flow of cooling water, and the amount of thermal deformation, this correspondence map being employed in the cooling device for an internal combustion engine according to one or more embodiments of the present invention.

FIG. 2 is an explanatory view illustrating an example of the correspondence map described above. In FIG. 2, a correspondence map is illustrated as a contour line diagram showing the amount of thermal deformation. In this contour line diagram, the horizontal line indicates temperature differences ΔT, and the vertical line indicates the volume of flow of the cooling water supplied to the heat exchanger 14. Within the frame in FIG. 2, boundary lines are drawn between areas R1 to R7, and these boundary lines, in other words, dashed lines and a solid line (boundary line Q1) each indicates a contour line corresponding to the amount of thermal deformation.

The area R1 indicates an area with the largest amount of thermal deformation, and the area R7 indicates an area with the smallest amount of thermal deformation. For the areas R1 to R7, the amount of thermal deformation decreases in the order of the areas R1, R2, R3, R4, R5, R6, and then R7.

The amount of thermal deformation expressed in the correspondence map will be further described. The amount of thermal deformation is the amount representing the state of deformation of the heat exchanger 14 and the degree of expansion of the heat exchanger 14, each of which is caused by the cooling water supplied to the heat exchanger 14. In general, the state of deformation and the degree of expansion vary from part to part constituting the heat exchanger 14.

Thus, by taking an appropriate weighted average of all the parts constituting the heat exchanger 14, the amount of thermal deformation of the heat exchanger 14 as a whole is defined. Note that it may be possible to define the amount of thermal deformation by setting the weight defined for each of the parts at the time of taking the average. By setting the weight of each part constituting the heat exchanger 14 in a manner such that the weight increases with an increase in the degree of importance that each of the parts carries to maintain functions of the heat exchanger 14, it is possible to define the amount of thermal deformation as an index that more appropriately represents a possibility of damage that the heat exchanger 14 suffers due to thermal deformation.

As described above, at the time when the heat exchanger 14 is, for example, designed and manufactured, the amount of thermal deformation occurring in the heat exchanger 14 due to thermal impact can be determined so as to depend on the structure of the heat exchanger 14 and be associated with two items: the temperature difference ΔT and the volume of flow of the cooling water supplied to the heat exchanger 14. In other words, it is possible to determine a relationship among the three items: the temperature difference ΔT, the volume of flow of the cooling water supplied to the heat exchanger 14, and the amount of thermal deformation. The amount of thermal deformation can be regarded as a function determined on the basis of two parameters: the temperature difference ΔT and the volume of flow of the cooling water supplied to the heat exchanger 14. Thus, this function depends on the structure of the heat exchanger 14, and can be obtained through various methods including an experimental method and a numerical method at the time when the heat exchanger 14 is, for example, designed and manufactured.

The correlation among the three items: the temperature difference ΔT between the inlet temperature T1 and the outlet temperature T2; the volume of flow of the cooling water supplied to the heat exchanger 14; and the amount of thermal deformation occurring in the heat exchanger 14 due to thermal impact is stored in the memory 23*a* as a correspondence map. The correspondence map is read from the memory 23*a*, and then, is used by the control unit 23 to perform control. Note that, in place of the correlation among the three items described above, it may be possible to use, as the correlation, a combination of two items: a temperature difference ΔT and the volume of flow of the cooling water supplied to the heat exchanger 14 in the case where the amount of thermal deformation is equal to the threshold amount of thermal deformation, and the control unit 23 uses this combination to perform control. In other words, it may be possible to store, in the memory 23*a*, the combination of two items: the temperature difference ΔT and the volume of flow of the cooling water supplied to the heat exchanger 14 in the case where the amount of thermal deformation is equal to the threshold amount of thermal deformation.

It should be noted that, since the correspondence map is determined so as to depend on the structure of the heat exchanger 14, it may be possible to employ a configuration in which, when the heat exchanger 14 is replaced, the correspondence map stored in the memory 23*a* is updated, and a correspondence map corresponding to the replaced heat exchanger 14 is stored. As the correspondence map corresponding to the heat exchanger 14 is stored in the memory 23*a*, the control unit 23 can perform control suitable to the heat exchanger 14.

Next, the threshold amount of thermal deformation will be described. The threshold amount of thermal deformation is set to be the maximum value of the amount of thermal deformation with which damage does not occur in the heat exchanger 14. In other words, the threshold amount of thermal deformation is defined as the maximum value of the amount of thermal deformation that the heat exchanger 14 can accept. In the case where the amount of thermal deformation exceeding the threshold amount of thermal deformation occurs in the heat exchanger 14, there is a possibility that the heat exchanger 14 is damaged. Note that, in order to ensure safety, it may be possible to define the threshold amount of thermal deformation as a value smaller than the maximum value of the amount of thermal deformation that the heat exchanger 14 can actually accept.

In one or more embodiments of the present invention, the amount of thermal deformation on the boundary line Q1 between the area R3 and the area R4 is set to be the threshold amount of thermal deformation, as one example. The correspondence map illustrated in FIG. 2 is divided by the boundary line Q1 into two areas: an area where the amount of thermal deformation exceeds the threshold amount of thermal deformation, and an area where the amount of thermal deformation does not exceed the threshold amount of thermal deformation.

A method of setting, by the control unit 23, the volume of flow of the cooling water will be described. On the basis of the temperature difference ΔT detected using the first temperature detecting unit 21 and the second temperature detecting unit 22, the control unit 23 sets the volume of flow of the cooling water supplied to the heat exchanger 14. At this time, the control unit 23 sets the volume of flow of the cooling water so that the amount of thermal deformation is smaller than or equal to the threshold amount of thermal deformation, in order to prevent the heat exchanger 14 from being damaged due to thermal deformation. In other words, if a point with a coordinate having the obtained temperature difference ΔT and the volume of flow of the cooling water set by the control unit 23 so as to correspond to the temperature difference ΔT is plotted on the correspondence map illustrated in FIG. 2, the plotted point is located on the boundary line Q1 or on the left side (R4 side) of the boundary line Q1 on the correspondence map in FIG. 2.

By setting the volume of flow of the cooling water so that the point with a coordinate having the temperature difference ΔT and the volume of flow of the cooling water is located on this boundary line Q1, the amount of thermal deformation does not exceed the threshold amount of thermal deformation and it is possible to supply as much cooling water as possible to the heat exchanger 14, which makes it possible to improve efficiency in cooling the cooling water. In other words, it is possible to cause the maximum amount of cooling water to flow through the heat exchanger 14 under a condition where damage due to thermal deformation does not occur in the heat exchanger 14.

From the correspondence map illustrated in FIG. 2, for example, in the case where the temperature difference ΔT is sufficiently small, in other words, in the case where a cooling water temperature detected by the first temperature detecting unit 21 and a cooling water temperature detected by the second temperature detecting unit 22 are close to each other, the amount of thermal deformation expected to occur due to supply of the cooling water to the heat exchanger 14 is small. Thus, in this case, there is no limitation on the volume of flow of the cooling water.

In other words, it is possible to arbitrarily select the volume of flow of the cooling water in the case where the temperature difference ΔT is small, and the boundary line Q1 does not cross any line made out of a set of points indicating the same temperature difference ΔT on the contour line diagram concerning the amount of thermal deformation.

On the other hand, in the case where the temperature difference ΔT increases due to, for example, activation of the engine 11, the amount of thermal deformation expected to occur due to supply of the cooling water to the heat exchanger 14 is large. In the case where a point designated by the temperature difference ΔT and the volume of flow of the cooling water is located within the areas R1 to R3, the amount of thermal deformation expected to occur due to flow-in of the cooling water to the heat exchanger 14 exceeds the threshold amount of thermal deformation. Thus, there is limitation on a selectable range for the volume of flow of the cooling water. In other words, the volume of flow of the cooling water is selected according to the temperature difference ΔT in a manner such that a point in the areas R4 to R7 or a point on the boundary line Q1 is selected.

As illustrated in FIG. 2, the boundary line Q1 is formed into a C-shaped curve so as to surround the areas R1 to R3, in other words, an area where the amount of thermal deformation exceeds the threshold amount of thermal deformation. Thus, in the case where the temperature difference ΔT is sufficiently large, a line made out of a set of points indicating the same temperature difference ΔT crosses the boundary line Q1 at two points on the contour line diagram concerning the amount of thermal deformation illustrated in FIG. 2. As for the coordinates of the two crossing points designated by the temperature difference ΔT and the boundary line Q1, coordinate values corresponding to the volume of flow of the cooling water are set to the first threshold M1 of the volume of flow and the second threshold M2 of the volume of flow. Assuming that the first threshold M1 of the volume of flow is a value smaller than or equal to the second threshold M2 of the volume of flow, in the case where the temperature difference ΔT is sufficiently large, the volume of flow of the cooling water is selected to be smaller than or equal to the first threshold M1 of the volume of flow, or greater than or equal to the second threshold M2 of the volume of flow. In one or more embodiments of the present invention, the volume of flow of the cooling water is set so as to be smaller than or equal to the first threshold M1 of the volume of flow.

As described above, before the cooling water is supplied to the heat exchanger 14, it is possible to set the volume of flow of the cooling water so that the amount of thermal deformation expected to occur due to supply of the cooling water to the heat exchanger 14 is a value smaller than or equal to the threshold amount of thermal deformation, even in the case where the temperature difference ΔT is large. Furthermore, during the time when the cooling water is being supplied to the heat exchanger 14, it is possible to set the volume of flow of the cooling water so that the amount of thermal deformation of the heat exchanger 14 is a value smaller than or equal to the threshold amount of thermal deformation. As a result, it is possible to prevent the heat exchanger 14 from being damaged due to thermal deformation.

In other words, even in a situation where a temperature difference ΔT increases due to, for example, activation of the engine 11, it is not necessary to preheat the heat exchanger 14 by always supplying the cooling water to prevent thermal deformation from occurring in the heat exchanger 14. In the case where temperatures of the engine 11 need to be raised as rapidly as possible, there is no need to supply the cooling water to the heat exchanger to prevent thermal deformation in the heat exchanger. Thus, generated heat is effectively used to raise temperatures of the engine 11. This brings an advantage in which an increase in temperatures of the engine 11 is not deterred due to processes for preventing occurrence of thermal deformation in the heat exchanger 14.

Before the cooling water is supplied to the heat exchanger 14, it is possible to check whether the volume of flow of the cooling water is excessively supplied and there is a risk of damage of the heat exchanger 14 due to thermal deformation. If such a risk exists, it is possible to control the volume of flow of the cooling water supplied to the heat exchanger 14 so as to be a level at which damage does not occur in the heat exchanger 14 due to thermal deformation.

Next, a process procedure performed by the cooling device for an internal combustion engine according to one or more embodiments of the present invention will be described with reference to the flowchart in FIG. 3. This processing is repeatedly performed at every calculation cycle set in advance.

Figure 3:
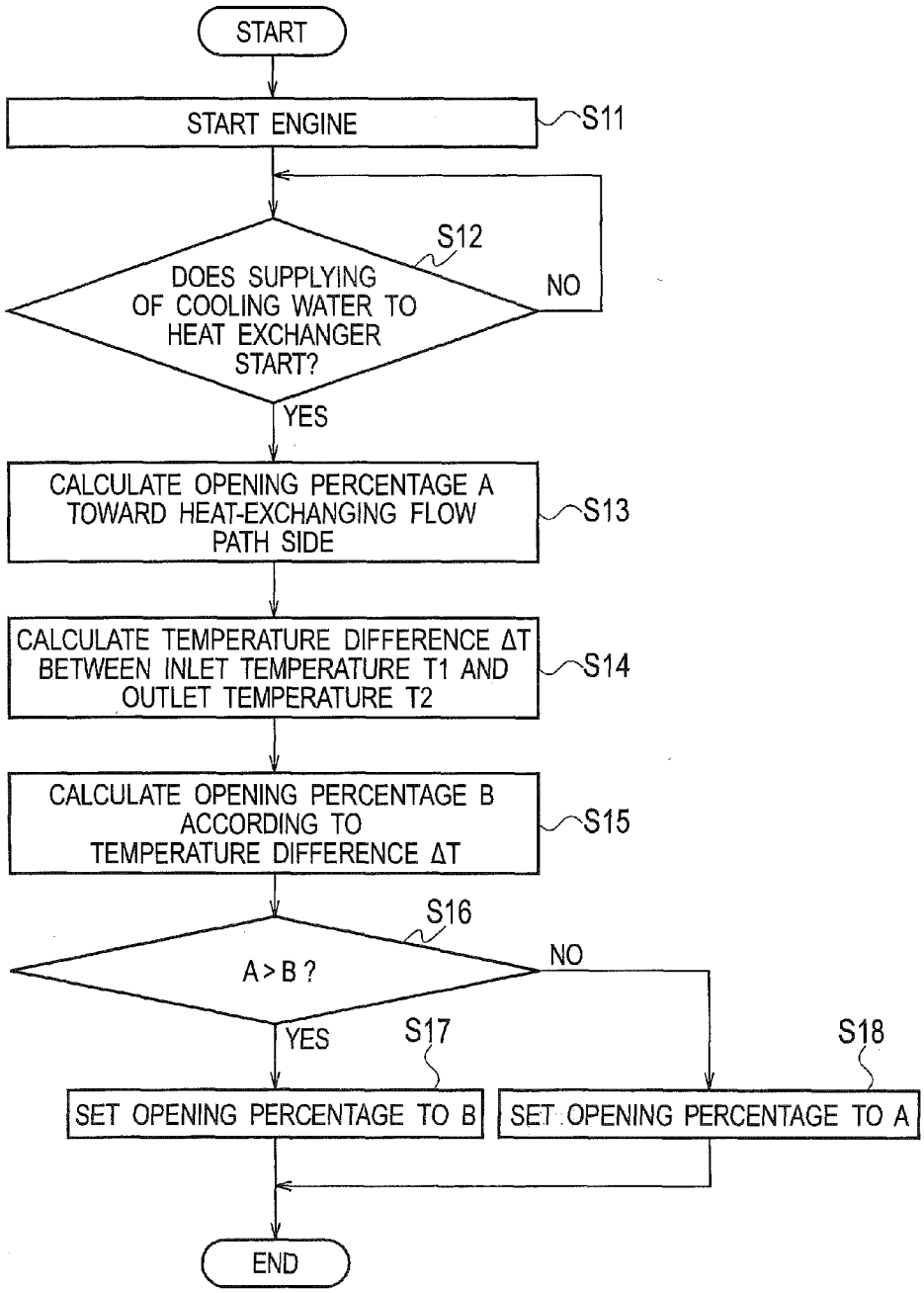
FIG. 3 is a flowchart showing a process procedure performed by the cooling device for an internal combustion engine according to one or more embodiments of the present invention.

First, the engine 11 starts to work in step S11 in FIG. 3. At this time, the circulation pump 13 starts to drive, causing the cooling water to flow into the cooling-water flow path L1 to cool the engine 11. Furthermore, the outlets of the three-way valve 12 operate in a manner such that the opening on the bypass flow path L2 side is opened, and the opening on the heat-exchanging flow path L3 side is closed. Thus, the cooling water flowing through the cooling-water flow path L1 passes through the bypass flow path L2, and returns to the circulation pump 13. With these operations, temperatures of the cooling water increase, and temperatures of the cooling water, which has passed through the engine 11, increase, for example, to 100° C. After this, temperatures of lubricant (for example, engine oil, and transmission oil) used in the internal combustion engine and the driving mechanism increase. Thus, friction of the lubricant reduces, which improves fuel efficiency.

Then, if the number of revolutions of and the torque of the engine 11 increase, knocking occurs in the engine 11, which leads to a deterioration in fuel efficiency. Thus, it is desired that temperatures of the engine 11 be reduced to prevent occurrence of knocking.

Figure 4:
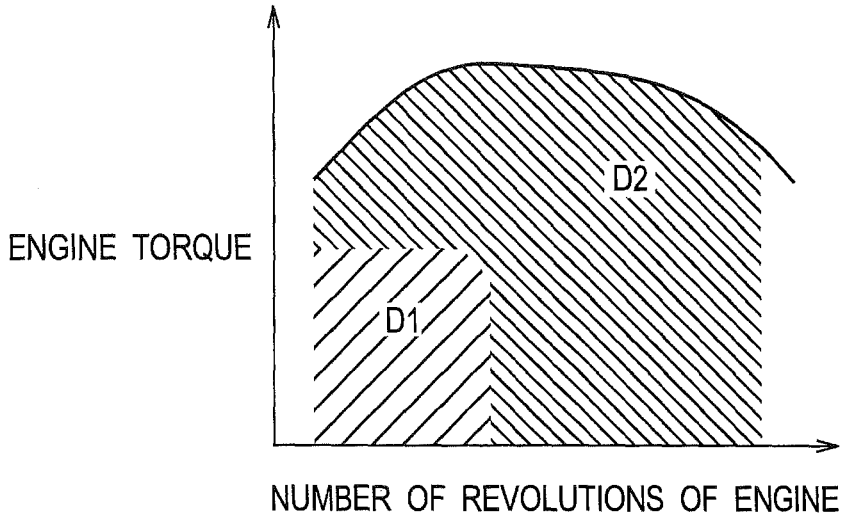
FIG. 4 is a characteristic diagram showing a relationship between the number of revolutions of engine and engine torque in relation to temperatures of the cooling water flowing through a cooling-water flow path, in accordance with one or more embodiments of the present invention.

FIG. 4 is a characteristic diagram showing a relationship between the number of revolutions of an engine and the engine torque in relation to temperatures of the cooling water flowing through the cooling-water flow path. This characteristic diagram illustrates cooling water temperatures (target water temperatures) that should be set according to the number of revolutions of an engine and the engine torque. In this characteristic diagram, the horizontal axis indicates the number of revolutions of an engine, and the vertical axis indicates the engine torque. Each point in areas shown in the characteristic diagram corresponds to the state of the engine designated by the number of revolutions of the engine and the engine torque.

When the area D1 (area located lower left) in the characteristic diagram in FIG. 4 is compared with the area D2 (area located upper right), the area D2 covers the larger number of revolutions of the engine and the larger engine torque, and hence, indicates a state where the engine 11 is more likely to suffer knocking. Thus, in order to prevent knocking, the cooling water temperature that should be set in the case where the state falls in the area D2 is lower than the cooling water temperature that should be set in the case where the state falls in the area D1.

In other word, in the characteristic diagram in FIG. 4, in the case where the relationship between the number of revolutions of the engine and the engine torque falls in the area D1, knocking does not occur, and the cooling water temperature needs to be increased (for example, to 100° C.) to improve fuel efficiency. On the other hand, in the case where the relationship between the number of revolutions of the engine and the engine torque falls in the area D2, knocking occurs in the engine 11, and hence, the cooling water temperature needs to be reduced to prevent knocking. Thus, at least part of the cooling water flowing through the cooling-water flow path L1 is caused to flow through the heat-exchanging flow path L3 to reduce the cooling water temperature.

In step S12 in FIG. 3, the state of the engine 11, in particular, the number of revolutions of the engine and the engine torque are monitored to determine whether to reduce the cooling water temperature, and also determine whether to start supplying the cooling water to the heat exchanger 14. If it is determined in step S12 to start supplying the cooling water to the heat exchanger 14, the process proceeds to step S13. On the other hand, if it is determined that the cooling water is not supplied, the state of the engine 11 is monitored again after a predetermined period of time elapses, and similar determinations are repeated.

In step S13, the control unit 23 controls output from the three-way valve 12, whereby part of the cooling water is supplied to the heat exchanger 14. More specifically, the opening percentage (hereinafter, referred to as an "opening percentage A") of the three-way valve 12 is set to determine the amount of cooling water supplied to the heat exchanger 14, and the degree of opening of the three-way valve 12 is controlled so as to be the opening percentage A. Here, as for the method of setting the opening percentage A, the opening percentage A can be set, for example, on the basis of the inlet temperature T1 detected by the first temperature detecting unit 21. Then, the outlet of the three-way valve 12 on the heat-exchanging flow path L3 side is opened to be the opening percentage A, whereby part of the cooling water passes through the heat-exchanging flow path L3, and is supplied into the heat exchanger 14. This leads to a fact that temperatures (outlet temperature T2) of the cooling water output from the heat exchanger 14 are detected by the second temperature detecting unit 22.

In step S14, the control unit 23 acquires an inlet temperature T1 of the cooling water detected by the first temperature detecting unit 21, and an outlet temperature T2 of the cooling water detected by the second temperature detecting unit 22 to obtain a temperature difference ΔT between them. In other words, "ΔT=T1−T2" is calculated.

In step S15, the control unit 23 refers to the correspondence map described above with respect to the temperature difference ΔT obtained in the step above, and sets the volume of flow of the cooling water supplied to the heat exchanger 14. More specifically, the volume of flow of the cooling water is obtained on the basis of the boundary line Q1 on the correspondence map shown in FIG. 2 by using the ΔT as the temperature difference on the horizontal axis. Then, an opening percentage of the three-way valve 12 on the heat-exchanging flow path L3 side for achieving this volume of flow is calculated, and the opening percentage thus obtained is set to be an "opening percentage B." This opening percentage B corresponds to an opening percentage at which the largest amount of cooling water can be supplied without the heat exchanger 14 being damaged due to deformation occurring as a result of thermal impact with the current temperature difference ΔT.

In step S16, the opening percentage A and the opening percentage B described above are compared in terms of the percentage. If the comparison result is not A>B (NO in step S16), the opening percentage of the three-way valve 12 on the heat-exchanging flow path L3 side is set to "A" in step S18. In other words, it is judged that damage due to thermal deformation does not occur even in the case where the opening percentage is set to the opening percentage A, which is initially set, and the opening percentage A is kept.

On the other hand, if the comparison result is A>B (YES in step S16), the opening percentage of the three-way valve 12 on the heat-exchanging flow path L3 side is set to "B" in step S17. In other words, in the case where the opening percentage is set to the opening percentage A, which is initially set, the volume of flow of the cooling water supplied to the heat exchanger 14 is excessively large, which may lead to damage to the heat exchanger 14 due to thermal deformation. Thus, the opening percentage is set to the opening percentage B. With this configuration, the volume of flow of the cooling water supplied to the heat exchanger 14 is controlled to a level at which the heat exchanger 14 is not damaged due to thermal deformation. Thus, unlike a conventional art, it may be possible to prevent damage to the heat exchanger 14 due to high-temperature cooling water suddenly entering the heat exchanger 14.

As described above, with the cooling device for an internal combustion engine according to one or more embodiments of the present invention, in the case where at least part of the cooling water is caused to flow on the heat-exchanging flow path L3 side in order to reduce temperatures of the cooling water flowing through the cooling-water flow path L1, the temperature difference ΔT between the inlet temperature T1 and the outlet temperature T2 of the cooling water supplied to the heat exchanger 14 is obtained. Then, the correspondence map shown in FIG. 2 is referred to on the basis of the temperature difference ΔT thus obtained, and the volume of flow of the cooling water flowing through the heat-exchanging flow path L3 is fixed. Thus, it is possible to cause the maximum amount of cooling water to flow through the heat-exchanging flow path L3 under the condition where the heat exchanger 14 is not damaged by thermal deformation. This makes it possible to prevent the heat exchanger 14 from being damaged by thermal impact, and rapidly reduce temperatures of the cooling water flowing through the cooling-water flow path L1.

Furthermore, the correspondence map contains the boundary line Q1 that separates an area where the amount of thermal deformation exceeds the threshold amount of thermal deformation from an area where the amount of thermal deformation does not exceed the threshold amount of thermal deformation, and the volume of flow of the cooling water flowing through the heat-exchanging flow path L3 is set so as to be located on this boundary line Q1, whereby it is possible to reduce temperatures of the cooling water in a more efficient manner.

Furthermore, the three-way valve 12 has the outlet on the heat-exchanging flow path L3 side and the outlet on the bypass flow path L2 side, each of which can be set into a fully closed state. Thus, at the start of the engine 11, the outlet on the heat-exchanging flow path L3 side is brought into the fully closed state to flow all the cooling water to pass through the bypass flow path L2, so that temperatures of the cooling water flowing through the cooling-water flow path L1 can be rapidly increased. In addition, the first temperature detecting unit 21 is provided on the upstream side of the three-way valve 12, in other words, in the vicinity of the outlet side of the cooling-water flow path L1, and a temperature detected by this first temperature detecting unit 21 is used as the inlet temperature T1 of the heat exchanger 14. Thus, even in the case where the cooling water is not supplied to the heat-exchanging flow path L3, it is possible to recognize the inlet temperature T1, which makes it possible to further improve control of the volume of flow of the cooling water.

Embodiments of a cooling device for an internal combustion engine, and a cooling method for an internal combustion engine are described above. However, these embodiments are merely examples described for facilitating understanding of the present invention, and the present invention is not limited to these embodiments. The technical scope of the present invention is not limited to the technical matters specifically disclosed in the embodiments described above, and includes, for example, various modifications, changes, and alternative techniques that can be derived from the disclosed technical matters.

With the cooling device for an internal combustion engine, and the cooling method for an internal combustion engine, according to one or more embodiments of the present invention, the inlet temperature and the outlet temperature of the heat exchanger are detected to obtain a temperature difference between them. By referring to this temperature difference and a correlation stored in the storage unit, the volume of flow of the cooling water supplied to the heat exchanger is obtained. With this configuration, in the case where the cooling water having increased temperature is supplied to the heat exchanger to reduce the cooling water temperature, it is possible to alleviate thermal deformation occurring in the heat exchanger. Thus, this cooling device and cooling method can be used to prevent a heat exchanger from being damaged due to thermal deformation in the case where cooling water having increased temperature is supplied to the heat exchanger for cooling the heat exchanger.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

11 engine (internal combustion engine)
12 three-way valve (switching unit)
13 circulation pump
14 heat exchanger
21 first temperature detecting unit (inlet temperature detector)
22 second temperature detecting unit (outlet temperature detector)
23 control unit (controller)
23*a* memory (map storage unit)
L1 cooling-water flow path
L2 bypass flow path
L3 heat-exchanging flow path

The invention claimed is:

1. A cooling device for an internal combustion engine, comprising:

a cooling-water flow path through which cooling water for cooling an internal combustion engine passes therethrough;

a switching unit provided on an outlet side of the cooling-water flow path, and configured to branch the cooling-water flow path into either a heat-exchanging flow path having a heat exchanger for cooling the cooling water disposed therein or a bypass flow path without the heat exchanger, or both;

a circulation pump that delivers, to the cooling-water flow path, cooling water passing through the heat-exchanging flow path and the bypass flow path;

an inlet temperature detector that detects a temperature of the cooling water supplied to the heat exchanger;

an outlet temperature detector that detects a temperature of the cooling water discharged from the heat exchanger; and a controller that controls distribution, in the switching unit, of a volume of flow of the cooling water to the heat-exchanging flow path and the bypass flow path, wherein the controller includes a storage unit that stores a correlation between the amount of thermal deformation occurring in the heat exchanger and a temperature difference between a first cooling water temperature detected by the inlet temperature detector and a second cooling water temperature detected by the outlet temperature detector, and wherein, when the cooling water is supplied to the heat-exchanging flow path, the controller refers to the temperature difference and the correlation to obtain a volume of flow of the cooling water supplied to the heat-exchanging flow path so that the amount of thermal deformation is less than or equal to a threshold amount of thermal deformation set in advance, and controls distribution, by the switching unit, of the volume of flow of the cooling water to achieve the obtained volume of flow of the cooling water.

2. The cooling device for an internal combustion engine according to claim 1, wherein the controller sets, to the correlation, a boundary line that separates an area where the amount of thermal deformation exceeds the threshold amount of thermal deformation from an area where the amount of thermal deformation does not exceed the threshold amount of thermal deformation, and sets, along this boundary line, the volume of flow of the cooling water flowing through the heat-exchanging flow path.

3. The cooling device for an internal combustion engine according to claim 1, wherein the switching unit is capable of bringing, into a fully closed state, an opening of the switching unit on the heat-exchanging flow path side and an opening of the switching unit on the bypass flow path side, and wherein the inlet temperature detector is provided in a vicinity of the outlet side of the cooling-water flow path on an upstream side of the switching unit.

4. A cooling method for an internal combustion engine, comprising:

causing cooling water to flow through a cooling-water flow path for cooling an internal combustion engine when the internal combustion engine is started;

switching a flow path of the cooling water at a time of reducing an elevated cooling water temperature that is raised due to the cooling water passing through the cooling-water flow path, the switching being performed so as to cause at least part of the cooling water to flow through a heat-exchanging flow path having a heat exchanger disposed therein, and to cause a remainder of the cooling water to flow through a bypass flow path;

obtaining a temperature difference between a first cooling water temperature detected by an inlet temperature detector provided at an inlet of the heat exchanger on the heat-exchanging flow path, and a second cooling water temperature detected by an outlet temperature detector provided at an outlet of the heat exchanger on the heat-exchanging flow path; and referring to a correlation between the temperature difference and the amount of thermal deformation occurring in the heat exchanger to obtain a volume of flow of the cooling water flowing through the heat-exchanging flow path so that the amount of thermal deformation occurring in the heat exchanger is less than or equal to a threshold amount of thermal deformation set in advance, and controlling distribution of the volume of flow of the cooling water flowing through the heat-exchanging flow path and the bypass flow path, so as to achieve the obtained volume of flow of the cooling water.

5. The cooling device for an internal combustion engine according to claim 2, wherein the switching unit is capable of bringing, into a fully closed state, an opening of the switching unit on the heat-exchanging flow path side and an opening of the switching unit on the bypass flow path side, and wherein the inlet temperature detector is provided in a vicinity of the outlet side of the cooling-water flow path on an upstream side of the switching unit.

* * * * *